United States Patent [19]

Batterton et al.

[11] 4,106,212

[45] Aug. 15, 1978

[54] GRAIN DRYER SIDEWALL CONSTRUCTION AND METHOD OF DRYING GRAIN

[75] Inventors: Elmo L. Batterton; Melvin J. Lonsdale, both of Morton, Ill.

[73] Assignee: Meyer Morton Co., Morton, Ill.

[21] Appl. No.: 705,159

[22] Filed: Jul. 14, 1976

[51] Int. Cl.[2] ..... F26B 19/00

[52] U.S. Cl. ..... 34/65; 34/174

[58] Field of Search ..... 34/65, 47, 168, 174, 34/233; 52/245

[56] References Cited

U.S. PATENT DOCUMENTS

| | | | |
|---|---|---|---|
| 1,424,565 | 8/1922 | Goskar | 34/65 |
| 2,706,345 | 4/1955 | Arndt | 34/174 |
| 3,313,040 | 4/1967 | Mathews | 34/174 |
| 3,440,734 | 4/1969 | Batterton et al. | 34/65 |
| 3,755,917 | 9/1973 | Lambert, Jr. | 34/233 |

*Primary Examiner*—John J. Camby
*Assistant Examiner*—Larry I. Schwartz
*Attorney, Agent, or Firm*—Hill, Gross, Simpson, Van Santen, Steadman, Chiara & Simpson

[57] ABSTRACT

A grain dryer for removing moisture from shelled corn, milo, wheat, barley, oats, soy beans, and various other grains, a pair of walls, of which the outer is perforated throughout the working area while the inner has a plurality of unperforated sections, the walls defining a flow path for the grain therebetween, which path varies in width, air passed through the walls and the grain therebetween forming the drying, and the dryer being substantially of the continuous flow type. The invention also contemplates a new method of drying grain.

6 Claims, 5 Drawing Figures

GRAIN DRYER SIDEWALL CONSTRUCTION AND METHOD OF DRYING GRAIN

SUMMARY OF THE INVENTION

The instant invention is an improvement over the dryer shown in our U.S. Pat. No. 3,440,734 issued Apr. 29, 1969, entitled "Continuous Flow Grain Dryer," and which patent is assigned to the same assignee as the present application. The aforesaid patent is the most pertinent prior art to the present invention, to our knowledge.

While the instant invention possesses all of the advantages recited in the aforesaid patent for the previous structure it possesses different advantages based upon spaced inner and outer walls defining the grain paths therebetween. In both instances the inner wall has an upper hot air chamber and a lower cool air chamber separated by a floor therebetween. In the aforesaid patent both walls are perforated throughout and the path is of equal width throughout. In the instant invention the grain path is widened at a distance below the top to slow its flow, make the grain looser and easier for air to pass out through it. Certain sections of the inside wall are void of perforations to prevent over drying of the grain and increase the air flow at the point where it is most needed. With this arrangement faster evaporation is acquired, quicker warm-up of the grain kernels and more equal air flow at the top of the machine. The quality of drying and the performance of the machine both in grain volume that can be passed through the machine in relationship to horsepower efficiency, fuel efficiency and proper direction of the heated air whereby the efficiency of the machine shows a substantial increase.

Various other salient features and advantages of the instant invention will become apparent from the disclosures hereafter.

DETAILED DESCRIPTION OF THE PREFERRED EMBODIMENT

The illustrated embodiment of the instant invention or discovery is incorporated in a vertically disposed tank-like structure which may be made in various heights and widths, since the dryers are obviously made in various capacities depending upon the grain grower's desires or needs.

The dryer may be completely assembled and formed at the manufacturing plant, and carried in a horizontal position on a specially made truck equipped with elevating mechanisms. The truck may deliver the completed dryer to a point where there is a preformed ground foundation of concrete or the like as generally indicated by numeral 1 in FIG. 1, and then the dryer may be elevated by the truck mechanism to stand vertically on that foundation.

Figure 1:
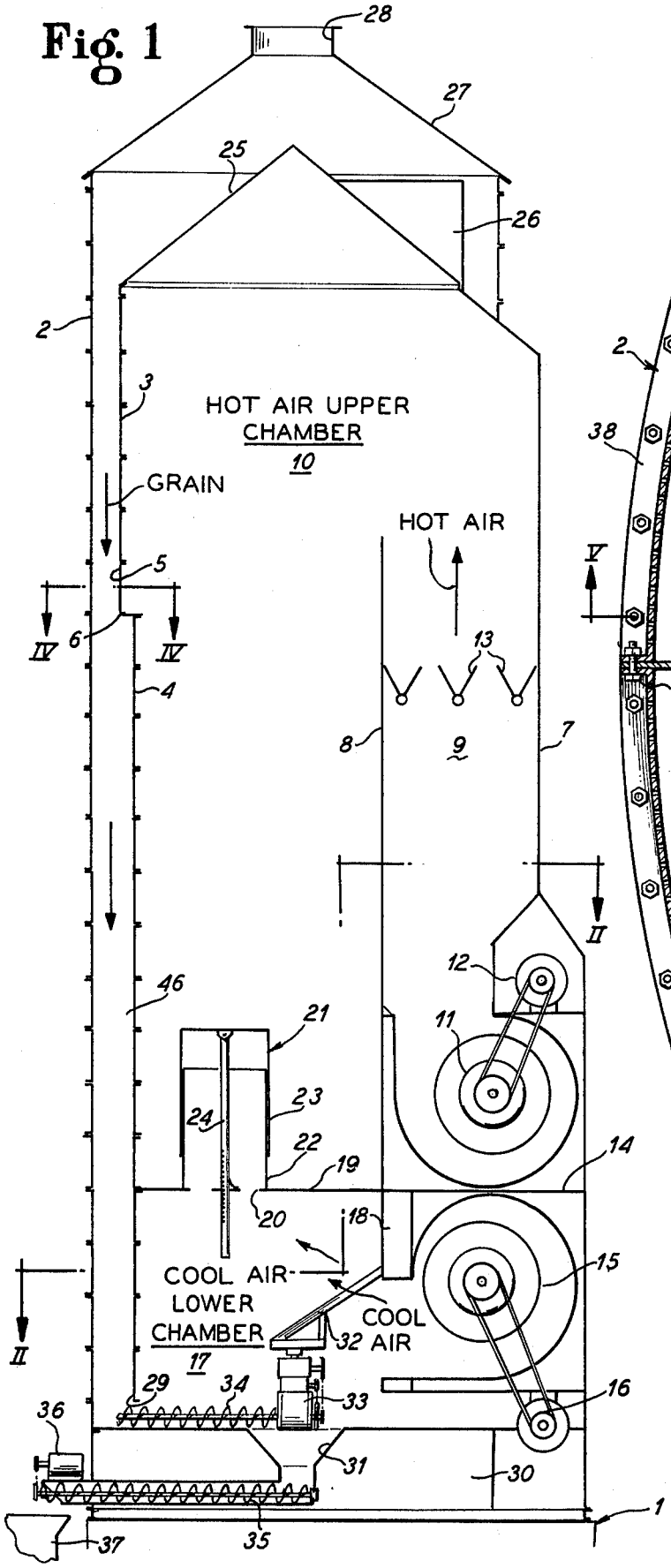
FIG. 1 is a somewhat diagrammatic view illustrating the general arrangement of the component parts of a dryer including principles of the instant invention.

The tank structure of the dryer embodies a different wall construction and a different discharge arrangement at the bottom for dried grain than is the case in our aforesaid patent. As generally indicated in FIG. 1 the wall construction consists of an outer perforated wall 2 and an inner wall having an upper portion 3 of greater diameter than a lower portion 4. The upper portion 3 is perforated, and the lower portion 4 is partially perforated as will be later described. The outer wall and both portions 3 and 4 of the inner wall define a path 5 down which the grain flows, this path widening at the point 6 in FIG. 1.

Figure 2:
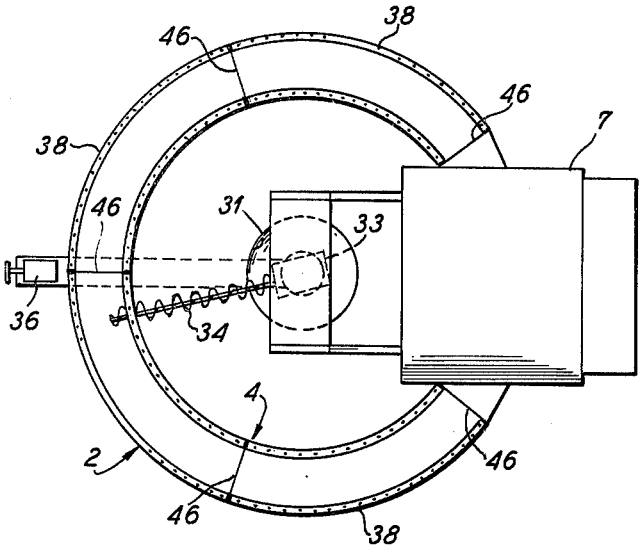
FIG. 2 is a somewhat diagrammatic plan view taken substantially as indicated by the staggered section line II—II of FIG. 1.

As best seen in FIGS. 1 and 2, an air supply housing 7 is inset into the walls of the dryer structure. Recessing the housing into the walls of the dryer decreases the lateral or cross dimension of the dryer to a sufficient extent so that the same when loaded horizontally upon a truck so that there will be no difficulty in transporting the housing beneath low bridges, viaducts, or other overhead structures. An upstanding wall 8 extending entirely across the housing defines an air path 9 open at the top and leading into a hot air or plenum upper chamber 10 inside the dryer structure proper. At the bottom of this hot air path 9 is a blower 11 substantially the width of the housing and driven by one or more motors 12, so disposed as to blow air upwardly through the passage 9 over a heating unit diagrammatically illustrated at 13 which is a high efficiency burner with 90° to 200° F. temperature range. Beneath the hot air fan 11 is a partition 14 extending across the housing to separate the hot air fan from a cold air fan 15 beneath the partition and driven by motor 16 which blows cool air into the cool air lower chamber 17 of the dryer, as more fully described in our aforesaid patent. Depending from the partition 14 is a support 18 for the housing of the cold air fan 15. Both the hot air fan and the cold air fan have their intakes through the sides of the housing outside the main portion of the dryer.

Also, as described and claimed in our aforesaid patent, the hot air upper or plenum chamber 10 is separated from the cool air lower chamber 17 by a partition 19 having an opening 20 therein. Over this opening 20 is a regulator, generally indicated by numeral 21, for controlling the flow of cold air through the opening 20 into the hot air adjacent the lower portion of the hot air chamber. This regulator 21 has a lower perforated cylindrical portion 22 with an imperfect enclosed top portion 23 telescoped there over. The imperforate upper portion 23 has a rack bar 24 connected thereto for adjusting the height of the imperforate element 23 relatively to the perforate cylinder 22 to control or regulate the amount of cold air entering the hot air chamber near the bottom thereof.

The hot upper chamber is covered by an inverted V-shaped top 25 to properly distribute the grain, and the top of the housing is provided with an inverted V-shaped laterally extending cover 26 to prevent grain accumulating and piling up on top of the housing inside the dryer. The top of the dryer structure proper is covered with a rainproof roof 27 in the center of which is an aperture 28 through which the grain is fed to the interior of the dryer by means of any suitable elevating structure, such as an endless bucket type conveyor. The entering grain then gravitates downwardly through the grain path 5 to the lower end portion to the dryer wherein it will be noted that the inner wall portion 4 terminates short of the outer wall 2 to provide an opening as indicated at 29 for the discharge of the grain from the flow path. At the bottom of the dryer a hollow platform 30 is provided having a funnel-shaped central opening 31 therein. A supporting structure 32 connected to the support 18 depending from the partition 14 carries a depending motor 33 which drives a sweep screw conveyor 34, one end of which extends into the grain path at the point 29. This motor not only turns the conveyor 34 bodily through a rotary path but also turns it around its own axis to draw out the grain through the opening 29 and deposit it into the funnel-shaped portion 31 where the grain is connected with a straight screw conveyor 35 passing out of the dryer from the bottom and which is driven by a motor 36 to remove the grain from the dryer and deposit it in any recepticle 37 which may be dumped into a truck or other vehicle for transporting the dried grain.

The novel sidewall construction of the dryer will now be described. The outer wall 2 is made up of arcuate sections 38 all of which are perforated with relatively fine holes providing, for example, 33% open area. Each of these arcuate sections are flanged at the top, at the bottom and vertically at each end of the section, such a section being more fully disclosed and claimed in our aforesaid patent. All of the flanges are turned outwardly, the bottom flange of an upper section being bolted as indicated at 39 in FIG. 5 through its lower flange to the upper flange of an under section. Since the inside wall portions 3 and 4 terminate short of the other wall portion, the inner wall portions 3 and 4 must be supported by the outer wall. To this end, the lower section 40 of the outer wall is of stronger material than the other sections and not perforated except for the opening for the conveyor 35, thus giving a substantial base for the outer wall. The upper inner wall portion 3 is made and put together in similar manner, but the sections 41 have a smaller radius. Lower portion 4 of the inner wall is also constructed in the same way but of sections of still less radius so that the grain path is enlarged, as stated above, at point 6. As seen best in FIG. 2, the wall sections are of such size as to form approximately 1/5 of a circle, the other fifth being occupied by the housing 7. All of the flanges of the inner wall portions 3 and 4 sections are turned inwardly so that the grain path is smooth throughout. All of the sections of the upper portion 3 of the inner wall are perforated in the manner of the outer wall, but certain of the sections 42 of the inner wall portion 4 are not perforated above the partition 19 but are perforated in the same manner there below.

Figure 4:
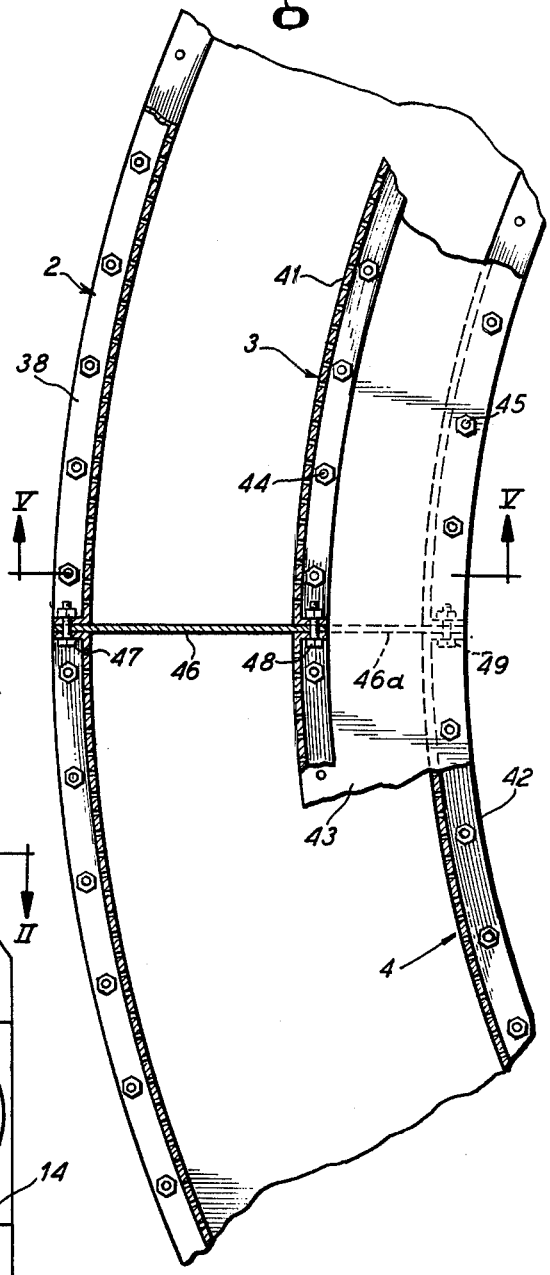
FIG. 4 is an enlarged fragmentary plan sectional view, with parts broken away to show structure therebeneath illustrating how both divisions of the inside wall are supported via the outside wall.
Figure 5:
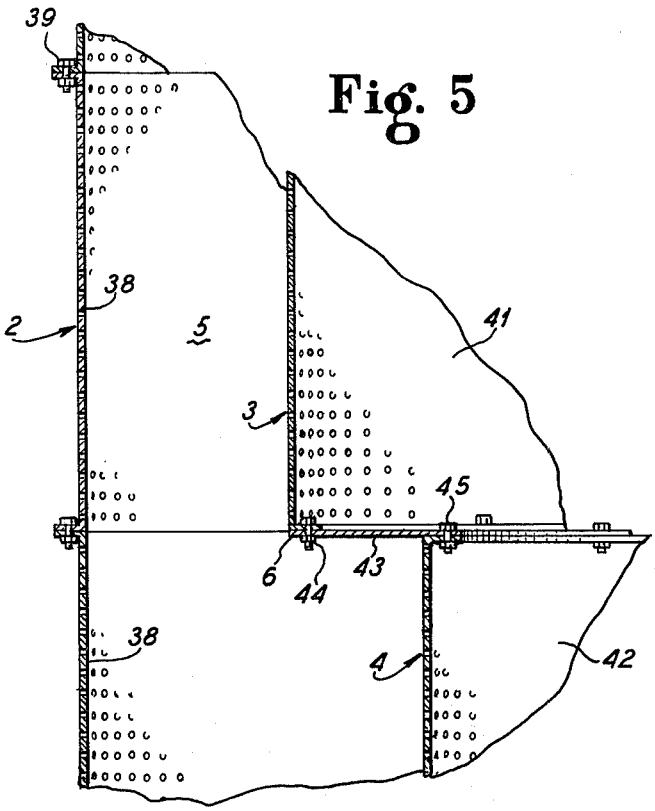
FIG. 5 is an enlarged fragmentary sectional view taken substantially as indicated by the line V—V of FIG. 4.

With reference to FIGS. 4 and 5, it will be seen that where the grain path is widened at the point 6, an arcuate panel complementary curved in accordance with the section 41 of the upper portion of the inner wall structure and sections 42 of the lower portion 4 of the inner wall structure. Each panel 43 is bolted as indicated at 45 to the lower flange of the section 41 as indicated at 44 and through the upper flange of a section 42 as indicated at 45 in FIG. 5. Except for the marginal bolt holes the flat curvate, panels 43 are preferably completely imperforate. By way of example, the horizontal panels 43 are the length corresponding to the length of the respective sections of the inner wall portions 3 and 4, and the height of all wall sections for the outside and inside wall may be 15 inches, which dimensions are not critical, but are highly satisfactory for assembly and performance of the dryer.

In order that the outer wall may support both portions 3 and 4 of the inner wall structure, vertical panels, imperforate except for marginal bolt holes are connected between adjacent ends of the outer wall and inner wall panels as indicated at 47 and 48 in FIG. 4. These panels 46 may be of any desired length consistent with ease in construction of the dryer, and if there are a number of them they are disposed in end to end relationship in a vertical line. For the lower portion 4 of the inner wall a vertical panel may be stepped down so that it underlies a lateral panel 43 and is bolted to the upper section 42 of the inner wall portion 4 as indicated at 49 in FIG. 4; or a panel section of full width between the outer wall and a portion for the inner wall may be utilized. With the instant dryer, a satisfactory dimension for the grain path 5 may be 7.25 inches between the outer and inner wall portion 3 and 12 inches between the outer wall and inner portion 4. These dimensions are not critical but are highly satisfactory in operation.

Figure 3:
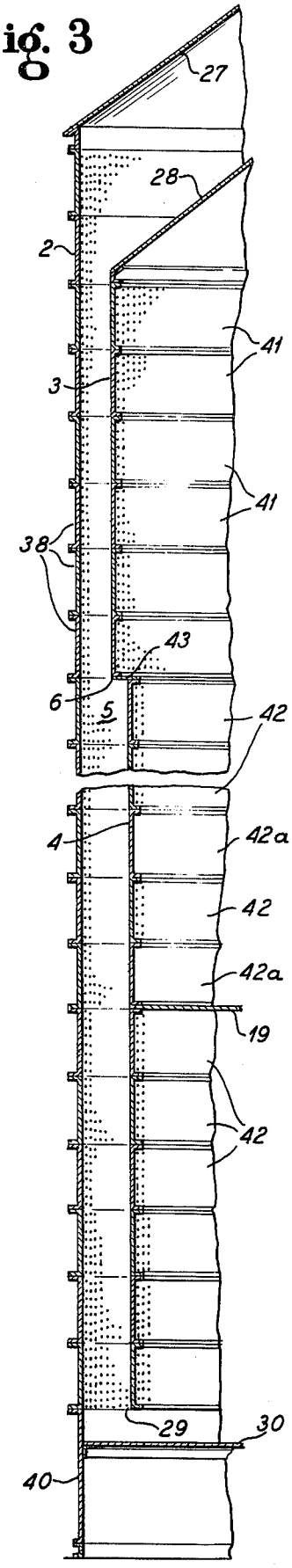
FIG. 3 is an enlarged detailed vertical sectional view of the sidewall construction of the dryer taken at the left hand side of FIG. 1.

As seen best at FIG. 3, immediately above the partition 19 is a wall section panel **42*a* that is imperforate except for bolt holes in the flanges thereof, above that is a perforate section 42 and above that another imperforate section 42*a***.

In operation the instant dryer has very high efficiency. By way of explanation, the grain comes to the dryer in a wet moisture condition. This varies greatly with the type of grain, corn usually has a high moisture level at the beginning of harvest and moves on down the temperature scale with a spread of 15% or more. Wheat and soy beans, and other small grains, usually have a much smaller moisture spread from harvest so safe storage moisture of 10% or less, usually closer to 5% to 6%.

For example wet corn may enter the dryer at 30% moisture level which must be brought down to approximately 15.5% and then down to 13.5–14%, which is usually considered safe storage levels with adequate aeration. The corn must be reduced in moisture contents to approximately 15.5% to avoid dockage when the corn is delivered to the local commercial elevator.

The amount of cubic feet per minute per bushel of grain and temperatures in the upper hot or plenum chamber must vary with the different grains depending somewhat on the structure of the grain itself and size of kernel.

Taking corn for example, we have found that 80 cubic feet per minute per bushel at 70° outside ambient temperature is satisfactory. This amount of cubic feet per minute per bushel may go up to 120 cubic feet per bushel and some dryers even run higher than that. After ambient air goes through the fan and past the burner 13 it reaches the plenum chamber at a temperature approximately 190° and possibly approximately 98 cubic feet per minute per bushel is passing through the flowing grain. Since the surface moisture at that time is high the air will almost have a cooling effect on the corn instead of heat in this first stage because of high evaporation rate. It makes little difference if too much air or too much temperature occurs at the beginning of the first step of the process. After the surface moisture, the kernel starts to pick up temperature on the outside surface, and this causes the vapor pressure on the outside of the kernel to be greater than on the inside. That is for a very short period of time, and the air is actually driving moisture into the kernel instead of out and causes the kernel to swell to some degree. Corn has three relatively heavy coats and can stand the expansion without causing the grain to split at the surface or deeper.

In soy beans this swelling of the kernel is a very critical point, and the plenum temperature must be lowered to 130° approximately because soy beans have a very thin coat on the outside, and it would cause the bean to split and this would cause a dock at the local grain elevator.

Going back now to corn as an example, this swelling of the kernel goes on for a very short period of time and then heat is conducted into the center of the kernel and causes the vapor pressure on the inside of the kernel to rise greater than on the outside. At this point the heat moving into the center of the kernel by conduction and the moisture moving out the drying process is bringing the moisture level down to the desired point. After the grain passes from the hotter section to the cooling section the corn is cooled down for proper storage or shipment and an effort is made to get this as near as possible to 10° of outside ambient temperature by continuing to pass cool air from the inside to the outside wall. The cool air is heated at that point just from the heat in the mass of corn and even in the cool section at the bottom of the dryer the drying continues to go on for a short period of time. Most of the time 1 to 1.5% of moisture is removed in that cool air section.

The wall design in the instant invention usually reduces the air flow at the point where it is most needed. In the upper path or narrower portion of the flow path for the grain, the grain moves more feet per minute than it does in the lower wider section of the path. In that lower section, the grain stays less compacted and looser and makes it easier for the air to pass out through it. Also at the beginning of the drying process the 190° air in the narrow part of the path begins to lose condensation adjacent the outer wall causing the inner and outer wall moisture differential to be greater. In this way, by having a narrow section at the beginning of the drying cycle, faster evaporation, quicker warmup of the grain kernels and more equal air flow at the top portion of the dryer is established.

Tests have shown that at the point the grain passes from the narrow path into the wider path that the grain stays very loose for the first several 15 inch structural sections of the wall, making easier passage for the air while still at a relatively high moisture level. Moving down the grain wall in the wider part of the path until approximately the lower ⅓ portion of the dryer is reached we find the imperforate sections 42*a* alternating with the perforate section 42 on the inside wall only. This structure reduces the amount of air flow in the bottom portion of the drying chamber where the corn is becoming relatively dry and only needs a minimal amount of heat and air flow to continue the drying process and this helps actually in preventing overdrying of the grain, but lets the air fan out a little bit in each direction from the existing opening and continues to dry the outside wall that is always a little wetter than the inside wall.

It will be appreciated that the number of imperforate and perforate sections alternating and the number of wall structural sections forming the narrow part of the path may vary in number depending upon the size of the dryer which according to its capacity may be from 16 feet high to over 60 feet high.

From the foregoing, the advantages of the instant invention will be apparent as above pointed out.

I claim:

1. A continuous flow grain dryer of the upright type having a pair of spaced inner and outer walls having perforations therein and defining a path for the flow of grain therebetween with partition means defining the space in the inner wall into a hot air upper chamber and a cool air lower chamber, and means to supply hot air to the upper chamber and cool air to the lower chamber with means to control the admission of cool air through said partition into the lower portion of said upper chamber, wherein the improvement comprises:

the upper part of the inner wall defining a greater interior transverse area than the lower part of said wall, and transverse means connecting the two parts of said inner wall to provide a grain path of constant width above said transverse means, and a grain path of greater constant width below said transverse means.

2. The grain dryer of claim 1, wherein the grain path is widened approximately 66% below said transverse means.

3. The grain dryer of claim 1, wherein the grain path is widened from 7.25 inches to 12 inches below said transverse means.

4. The grain dryer of claim 1, wherein said transverse means comprises a flat imperforate plate means connecting the wider upper portion of the inner wall to the top of the lower narrower portion of the inner wall to form an abrupt widening of said grain path.

5. The grain dryer of claim 1, wherein the inner wall is made of sections secured together and including a plurality of imperforate sections alternating with at least one perforate section above said partition.

6. The grain dryer of claim 1, including spaced vertical panel sections connected to said outer wall and to both the wider upper portion and the lower narrower portion of the inner wall, whereby both the wider and narrower portions of the inner wall structure are supported by the outer wall.

* * * * *